US006098546A

United States Patent [19]

Schell

[11] Patent Number: 6,098,546

[45] Date of Patent: Aug. 8, 2000

[54] METHOD AND DEVICE FOR SECURITY PRINTING

[76] Inventor: Karel Johan Schell, Voorstraat 60, NL-2201 HX Noordwijk, Netherlands

[21] Appl. No.: 09/242,717

[22] PCT Filed: Jun. 23, 1998

[86] PCT No.: PCT/NL98/00362

§ 371 Date: Feb. 22, 1999

§ 102(e) Date: Feb. 22, 1999

[87] PCT Pub. No.: WO98/58802

PCT Pub. Date: Dec. 30, 1998

[30] Foreign Application Priority Data

Jun. 25, 1997 [NL] Netherlands ..... 1006401

[51] Int. Cl.[7] ..... B41M 1/10

[52] U.S. Cl. ..... 101/492; 101/119; 101/129; 101/153; 101/154; 101/170

[58] Field of Search ..... 101/115, 119, 101/120, 129, 150, 152, 153, 157, 170, 211, 492

[56] References Cited

U.S. PATENT DOCUMENTS

| | | | |
|---|---|---|---|
| 3,390,631 | 7/1968 | Koszul . | |
| 4,152,986 | 5/1979 | Dadowski et al. | 101/170 |
| 4,155,766 | 5/1979 | Hieber et al. | 101/170 |
| 4,445,432 | 5/1984 | Ford, Jr. et al. | 101/152 |
| 4,509,454 | 4/1985 | Verte et al. | 101/119 |
| 4,604,951 | 8/1986 | Ichikawa et al. | 101/153 |
| 4,672,893 | 6/1987 | Mammarella, Sr. | 101/170 |
| 5,323,700 | 6/1994 | Katsuyama et al. | 101/119 |
| 5,887,522 | 3/1999 | Bocko et al. | 101/492 |
| 5,931,090 | 8/1999 | Ohkawa | 101/119 |

FOREIGN PATENT DOCUMENTS

| | | | |
|---|---|---|---|
| 684 325 | 11/1939 | Germany . | |
| 7 812 603 | 7/1980 | Netherlands . | |
| 7812604 | 7/1980 | Netherlands | 101/119 |

*Primary Examiner*—Eugene Eickholt
*Attorney, Agent, or Firm*—Young & Thompson

[57] ABSTRACT

For security printing of documents, in particular banknotes, by printing a sheet or web using intaglio technology, an ink image is applied to transfer rollers (6) using rotary screen printing technology, said ink image is transferred from the transfer rollers to one or more intaglio plates which are provided with engravings and are fixed in or on the shell of a plate cylinder, and the ink present in the engravings of the intaglio plates is transferred to a sheet or web pressed against the plate cylinder (1) by a counter pressure cylinder (8).

2 Claims, 1 Drawing Sheet

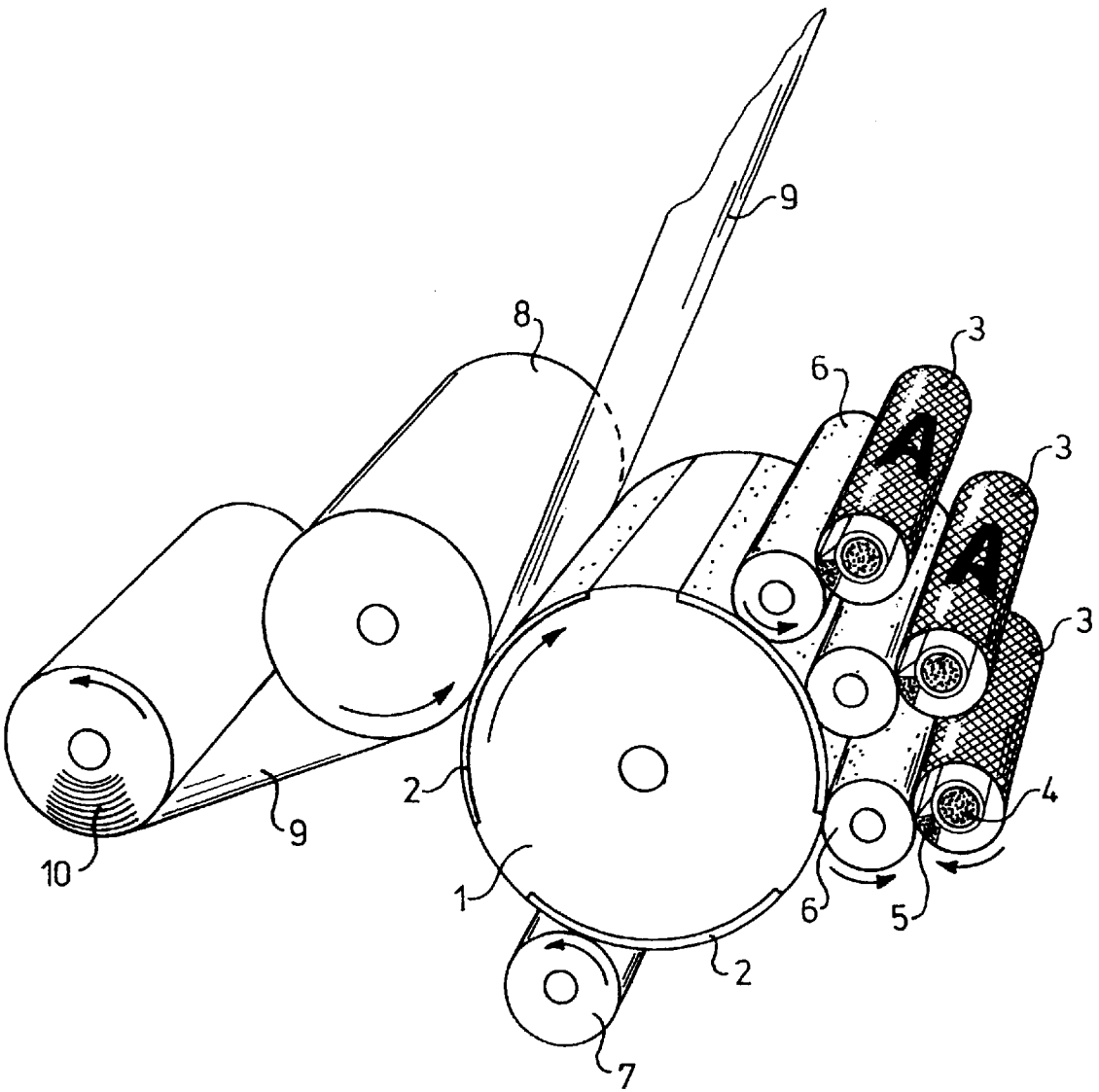
3
3
3
4
5
6
6
9
2
7
8
1
2
9
10

METHOD AND DEVICE FOR SECURITY PRINTING

The invention firstly relates to a method for security printing of documents, in particular banknotes, by printing a sheet or web using intaglio technology, comprising:

applying an ink image to one or more rotating transfer rollers, transferring the ink image from the transfer rollers onto one or more intaglio plates provided with engravings, which plates are fixed in or on the shell of a rotating plate cylinder, and transferring the ink present in the engravings of the intaglio plates onto a sheet or web pressed against the rotating plate cylinder by a rotating counter pressure cylinder.

When printing banknotes, an image is applied at least on one side of the paper with the aid of intaglio technology. This technology is derived from the old gravure technology. Since 1945 traditional gravure technology has been converted step by step into an industrial process and nowadays production speeds of 10,000 sheets per hour are achieved using what is known as Orlof technology. This speed is comparable to that of commercial offset presses. Intaglio provides the banknote with a relief which is discernible to the touch and offers attractive possibilities for providing the note with security features. Furthermore, a relief offers the possibility of applying additional colour tints using transparent inks, which additional tints are difficult to reproduce, as well as latent images, profiles of different heights being applied. Different images are generated by viewing at an angle. Recently, to protect banknotes against copying by colour copiers, intaglio images in so-called OVI inks (OVI: optical variable ink) have also been applied.

In traditional intaglio, the engravings are completely filled; during the printing process the ink is transferred to the paper, which results in an approximately 20 micron thick ink layer, which is discernible to the touch, on the paper.

In the case of conventional intaglio used on an industrial scale, the engravings are not completely filled, probably as a consequence of combining filling the engravings via a stencil cylinder with wiping clean the areas around the cells with the aid of a wiper cylinder. The relief which is discernible to the touch and usually has a height of 40 microns is made up of an approximately 20 micron thick ink layer and a 20 micron embossing. The embossing is a permanent deformation of the paper, produced by plastic deformation during the intaglio process.

With high speed intaglio only a thin layer of ink is applied in the engravings. As a consequence, a tinted embossing is produced as intaglio image during the intaglio process. The relief discernible to the touch—usually about 50 microns thick—is made up of a 10 micron thick ink layer and an embossing profile of about 40 microns.

It is possible to produce 10,000 sheets per hour with high speed intaglio; with conventional intaglio the maximum number of sheets that can be produced per hour is only 8,000. In the case of high speed intaglio relatively little time is available to introduce ink into the engravings. Moreover, the introduction pressure will have to be increased or the viscosity of the ink will have to be lower or it will have to be accepted that there is less ink in the engravings.

The pressure cannot be infinitely increased and the viscosity has a lower limit which is determined by the fact that the ink must not run out of the engravings.

A simple method for introducing a relatively small layer of ink onto the intaglio plates provided with engravings comprises placing one or more rotary transfer rollers between the stencil cylinder and printing plates mounted on the plate cylinder. Less ink on the intaglio plates provided with engravings means that the time required is shorter and that it is possible to work at a higher speed.

With the aim of applying less ink, it would be possible to produce the stencil image as a halftone. If, however, the halftone has to fill the engravings in the intaglio plates directly, there is a risk that the screen will be visible in the printed image. In order to avoid this, it would be necessary in this case as well to place a transfer roller between the stencil cylinder and the intaglio plate cylinder.

The aim of the invention is to solve the problems indicated above and to provide a method as indicated in the preamble which leads to high speed intaglio, which allows a wide variation in the ink viscosity, which results in greater register accuracy of the ink images on the intaglio plate and which enables easy metering of the ink to produce the desired layer thickness.

According to the invention, the method specified in the preamble is to this end characterised in that use is made of rotary screen printing technology for applying an ink image to the transfer roller or rollers.

Because use is made of screen printing technology for transferring the ink image to the transfer rollers, ink being forced by a squeegee through holes left open in the screen printing mesh, the viscosity of the ink is far less significant than in the case of the prior art. The thickness of the ink layer can easily be set by selecting the modulation of the frequency of the screen printing mesh (it being possible to adjust the ink supply by having holes which are more or less open). Because the ink layer on the transfer rollers virtually corresponds to the engravings of the intaglio plates, the so-called register accuracy of the ink images on the intaglio plates is high.

The invention also relates to an installation for security printing, in particular of banknotes, by printing a sheet or web using intaglio technology, comprising:

a rotary plate cylinder intended to accommodate one or more intaglio plates, provided with engravings, in the shell thereof, one or more rotary transfer rollers intended to transfer an ink image to the intaglio plates, means for feeding a sheet or web to the plate cylinder, and a rotary counter pressure cylinder to press the said sheet or web against the plate cylinder.

According to the invention, said installation is characterised by rotary screen printing rollers provided on the inside with an ink tube and a squeegee, in order to transfer an ink image to the transfer rollers.

It is pointed out that Netherlands Patent Application 7 812 603 (FIG. 2) describes a method for printing a substrate, comprising the application of the ink image by rotary screen printing technology, in particular a screen cylinder, to a transfer roller, transfer of the ink image from said transfer roller to raised parts of a plate cylinder and transfer of the ink present on the raised parts to a web pressed against the rotating plate cylinder by a rotating counter pressure cylinder. This method is used to print metal plates, a smooth image being produced on a nondeformable metal plate by means of a thin layer of ink under minimal pressure. The present invention relates to a completely different field of printing, namely relief printing, with which, by applying a very high contact pressure (for example 8 tonnes) between the plate cylinder and the counter pressure cylinder, the material of the paper web is pressed into the engravings, into which ink has been introduced by means of the transfer roller. Whereas in Netherlands Patent Application 7 812 603 use is made of raised parts on the plate cylinder, in the present invention use is made of gravure plates.

Furthermore, a method for security printing, in particular of banknotes, is disclosed in German Patent 684 325. An ink image is applied by means of expensive metal stencil cylinders treated by etching onto a plate cylinder provided with engravings, which ink image is transferred to a web pressed against the plate cylinder by a counter pressure roller. There are no transfer rollers, which in the case of the invention are essential to be able to transfer ink from the mechanically relatively weak screen printing rollers into the engravings of the plate cylinder.

The invention is outstandingly suitable for applying OVI inks (optical variable inks), which are difficult to process, and very expensive inks in relief printing with high register accuracy and with controlled very thin layer thickness. It is possible to operate at very high speed (for example 10,000 sheets per hour) using what is known as an Orlov intaglio profile. In this case the paper is highly deformed, whilst relatively little ink is used. What is referred to as the iris effect, in which colours gradually merge into one another, can be achieved in intaglio by introducing two inks, separated by a partition, into the screen printing cylinder, which is moved to and fro during printing.

The invention will now be explained in more detail with reference to the figure.

BRIEF DESCRIPTION OF THE DRAWING

The figure shows, diagrammatically, a perspective view of the installation with which the method according to the invention can be carried out.

The installation shown comprises:

a plate cylinder 1, in the shell of which three intaglio plates 2, provided with engravings, are fixed, three screen printing rollers 3, provided on the inside with an ink tube 4, provided with openings, and a fixed squeegee 5, three transfer rollers 6, which are placed between the screen printing rollers 3 and the plate cylinder 1, a wiper roller 7, and a counter pressure impression cylinder 8 to press a web 9, which is to be printed and which is unwound from a roll 10, against the plate cylinder 1.

During operation the rollers and cylinders rotate in the direction of the arrows.

The jacket of the screen printing rollers 3 is made of tensioned gauze, the holes of which are filled with the exception of the area that corresponds to an image to be printed, this being the letter A in the example shown. Ink is applied via the openings in the ink tube 4 onto the interior surface of the gauze cylinder of the screen printing rollers, the ink being forced through the gauze by the squeegee 5 at the location where the holes are open (the so-called screen printing mesh).

The ink forced through the gauze passes in the form of an ink image onto the transfer rollers 6, which, in turn, transfer said ink image into the engravings of the intaglio plates 2. The wiper roller 7 ensures that any ink outside the engravings is removed.

The ink in the engravings of the intaglio plates is transferred onto the web of material 9, which is pressed by means of the counter pressure cylinder 8 onto the plate cylinder 1 and consequently locally somewhat into the engravings.

The combination of rotary screen printing (1 to 4) and the interposed transfer rollers 6 ensures that the ink layer on the plate cylinder is relatively thin and that consequently it is possible to operate at very- high speed and with very high production capacity. Because the ink is forced through the screen printing mesh by the squeegee 5, the viscosity of the ink is of minor importance. The ink layer thickness can be metered by modulation of the frequency of the screen printing mesh (holes more or less open). The accuracy with which the ink layer is introduced into the engravings of the intaglio plates is also improved compared with conventional intaglio methods. Finally, a thinner and more accurately applied ink layer also means that the amount of ink with which the wiper roller, and in particular the removal fluid, has to cope is smaller.

What is claimed is:

1. Method for security printing of documents, in particular banknotes, by printing a sheet or web using intaglio technology, comprising:

applying an ink image to one or more rotating transfer rollers (6), transferring the ink image from the transfer rollers (6) onto one or more intaglio plates (2) provided with engravings, which plates are fixed in or on the shell of a rotating plate cylinder (1), and transferring the ink present in the cells of the intaglio plates onto a sheet or web (9) pressed against the rotating plate cylinder (1) by a rotating counter pressure cylinder (8), characterized in that use is made of rotary screen printing technology for applying an ink image to the transfer roller or rollers (6).

2. Installation for security printing of documents, in particular banknotes, by printing a sheet or web using intaglio technology, comprising:

a rotary plate cylinder (1) intended to accommodate one or more intaglio plates (2), provided with engravings, in or on the shell thereof, one or more rotary transfer rollers (6) intended to transfer an ink image to the intaglio plates (2), means for feeding a sheet or web (9) to the plate cylinder (1), and a rotary counter pressure cylinder (8) to press the said sheet or web against the plate cylinder (1), characterized by rotary screen printing rollers (3) provided on the inside with an ink tube (4) and a squeegee (5), in order to transfer an ink image to the transfer rollers (6).

* * * * *